United States Patent [19]

Dydyk

[11] 4,367,445

[45] Jan. 4, 1983

[54] IMPEDANCE TRANSFORMING THREE PORT POWER DIVIDER

[75] Inventor: Michael Dydyk, Scottsdale, Ariz.

[73] Assignee: Motorola Inc., Schaumberg, Ill.

[21] Appl. No.: 248,921

[22] Filed: Mar. 30, 1981

[51] Int. Cl.[3] ..... H01P 5/12

[52] U.S. Cl. ..... 333/127; 333/136

[58] Field of Search ..... 333/124, 125, 127, 128, 333/117, 118, 123

[56] References Cited

U.S. PATENT DOCUMENTS 3,091,743 5/1963 Wilkinson ..... 333/127

3,691,485 9/1972 Beck ..... 333/123

OTHER PUBLICATIONS

Ekinge, *A New Method of Synthesizing Matched Broad--Band TEM-Mode Three Ports,* IEEE Trans. on MTT, Jan. 1971.

Reed et al., *A Method of Analysis of Symmetrical Four--Port Networks,* IRE Trans. on MTT, Oct. 1956.

*Primary Examiner*—Paul L. Gensler

*Attorney, Agent, or Firm*—M. David Shapiro; Eugene A. Parsons

[57] ABSTRACT

A modification of a Wilkinson combiner/splitter is described wherein, by means of selection of the characteristic impedance of the transmission media and the value of the combining impedance, the combiner/splitter may be matched to input and output impedance which are not the same.

2 Claims, 4 Drawing Figures

- PRIOR ART -

IMPEDANCE TRANSFORMING THREE PORT POWER DIVIDER

FIELD OF THE INVENTION

This invention relates to a modification of a Wilkinson power splitter/combiner wherein the input and output impedances of the splitter/combiner may be different.

BACKGROUND OF THE INVENTION

A power splitter/combiner known as the Wilkinson power splitter/combiner is shown in FIG. 1. It is a three port device having ports 4, 6 and 8. Impedance $Z_0$, 10, may represent either a combining load or a source impedance. Transmission media 12 and 14 may be any sort of a transmission line such as open wire line, coaxial cable, waveguide, etc. Each line 12, 14 has a characteristic impedance equal to $\sqrt{2}Z_0$ as shown. The right end of the each of these lines is connected via impedance 16 which has a value of $2Z_0$. Ports 6 and 8 are connected to impedances 22 and 24, each of these impedances having a value of $Z_0$. The splitter/combiner of FIG. 1 may be considered as a splitter if input port 4 is connected to a source of signal energy. In this case output ports 6 and 8 will each produce one-half of the input power less, of course, the losses in the system. Impedance 10, $Z_0$, represents the source impedance of the generator supplying the input power. Impedances 22 and 24, each having a value of $Z_0$, represent the load impedance of the two split loads. Each of the transmission media 12 and 14 are an odd multiple of one-quarter wavelength long in whatever the media provided. If the network of FIG. 1 is to be used as a power combiner, impedances 22 and 24 represent the source impedances of two source power generators. Impedance 10, also having a value of $Z_0$, represents the impedance of the load.

It may be seen that the Wilkinson design of FIG. 1 is limited in that the input and output impedances are all equal to $Z_0$. The design does not facilitate the use of different input and output impedances regardless of whether it is used as a combiner or a splitter. Where input and output impedances are required to be different, prior art systems have typically accomplished the required matching by adding electrical transformer elements at input and/or output ports. (Not shown.) These transformers may take the form of odd multiples of quarter wavelengths of transmission media having a characteristic impedance determined by the required input and output impedances which must be matched. This solution to the problem tends to provide a relatively expensive and bulky network. The larger networks reduce efficiency in terms of system losses.

SUMMARY OF THE INVENTION

In accordance with the problems and shortcomings of the above described single impedance sink/source-splitter/combiner, it is an object of the present invention to provide a simple modification of a Wilkinson splitter/combiner which allows matching of different input and output impedances.

It is another object of the invention to provide a splitter/combiner with capability of handling different input and output impedances over multi-octave bandwidths by cascading two or more sections.

These objects are accomplished by means of parameter selection based on the equations which are disclosed, infra.

These and other objects of the invention will become more apparent upon reading of the detailed description of the invention, below, together with the drawings in which.

DETAILED DESCRIPTION OF THE INVENTION

Figure 1:
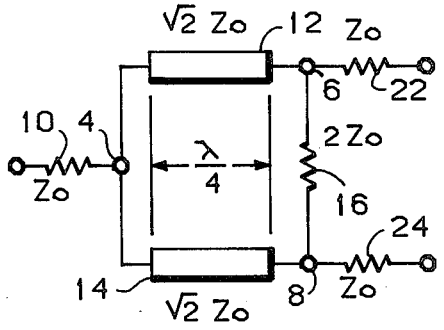
FIG. 1 is a schematic diagram of a prior art Wilkinson splitter/combiner.
Figure 2:
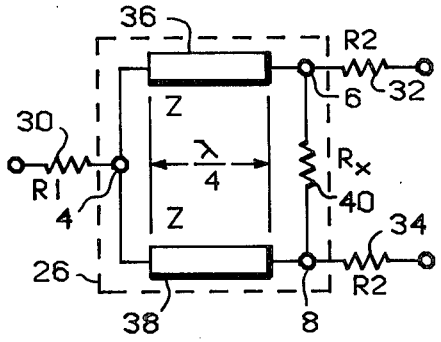
FIG. 2 is a schematic diagram of a single section of the improved splitter/combiner according to the invention.
Figure 3:
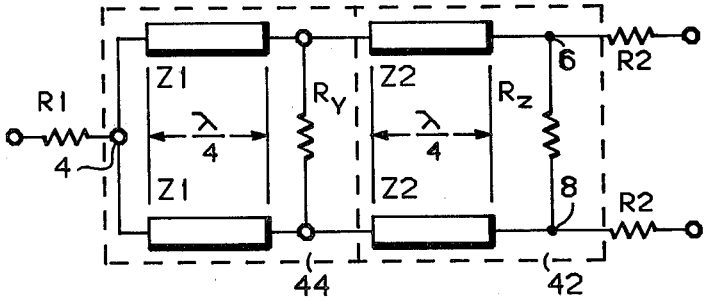
FIG. 3 is a schematic diagram of the improved invention of FIG. 2 showing an additional cascaded section for the purpose of broad banding the network.

Referring to FIGS. 1 and 2 it will be seen that FIG. 2 is a more generalized version of FIG. 1. It should be noted that like reference numerals in FIGS. 1, 2 and 3 represent like points or elements within each drawing. Dotted portion 26 of FIG. 2 represents a single section embodiment of the instant invention. It will be noted that the $Z_0$ values of the impedance of each port of the circuit of FIG. 1 are generalized into $R_1$, 30, and $R_2$, 32 and 34, values in FIG. 2. In this discussion it will be noted that the $Z_0$, $R_1$ and $R_2$ values are not directly or specifically related to an input or an output port, but may, in fact, be used as either. When the circuits of FIG. 1 and FIG. 2 are used as power splitters, the input would be at port 4 and identical outputs would appear at ports 6 and 8. This is true in both FIGS. 1 and 2. The circuit of FIG. 1, however, is limited to those cases where the input source impedance and the output load impedances are all equal to $Z_0$. The circuit of FIG. 2, being more generalized, indicates the impedance at port 4 as $R_1$ and the impedances at ports 6 and 8 as $R_2$. That is, the impedance associated with port 4 is impedance 30, equal to $R_1$; the impedances associated with ports 6 and 8, impedances 32 and 34 are each equal to $R_2$. When the devices of FIG. 1 and FIG. 2 are utilized as power combiners, the inputs would be at ports 6 and 8, also referred to herein as the second and third ports. The combined output would appear at port 4, also referred to as the first port. It should be noted that for design purposes it is unnecessary to be concerned about whether a given port is used as an input or an output port. It is only important to know what the desired external impedance is at a given port and that the external port impedance for the pair of ports 6 and 8 (the second and third ports) are the same.

Referring to FIG. 2, it may be seen that the impedance associated with the first port 4 is $R_1$ and the impedances 32 and 34 associated with ports 6 and 8 (the second and third ports) are $R_2$. Where the circuit is used as a power splitter, energy would be introduced into the system at terminal 4 and $R_1$, impedance 30, would represent the internal impedance of the source device. The right side of $R_1$ is connected via port 4 in common to the inputs of transmission media 36 and 38 which may be transmission line, coaxial cable, waveguide, or any other transmission media. Transmission media 36 and 38 will always have a length equal to an odd multiple of one-quarter of the wavelength of a nominal frequency at which the device is to be operated. A quarter-wavelength is generally preferred. The characteristic impedance of transmission media 36, 38 is arbitrarily labeled Z. The right-hand or output ends of transmission media 36 and 38 are joined by isolating impedance $R_X$, 40. The upper connecting point between $R_X$, 40, and transmission media output 36 is also connected to $R_2$ impedance 32, the impedance of the load on terminal 6. Point 8 at which $R_X$ impedance 40 is connected to the output of transmission media 38 is also connected to external load impedance $R_2$, 34. An important aspect of the invention lies in the mathematical relationship between $R_1$, $R_2$, Z and $R_X$:

$$Z = \sqrt{2R_1R_2} \tag{1}$$

$$R_X = 2R_2. \tag{2}$$

If these relationships are observed, the values of Z and $R_X$, so selected, will provide for matching of input and output terminals of circuit 26 to the $R_1$ and $R_2$ loads in a one section embodiment of the invention.

It may be seen, then, that the circuit of FIG. 2 together with equations (1) and (2) define a general case of the circuit of FIG. 1 wherein the port impedances are not equal, that is; $R_1$ is not equal to $R_2$ for a single section design. Where $R_1$ is equal to $R_2$ is equal to $Z_0$ the circuit of FIG. 1 results.

FIG. 3 represents an extension of the circuit of FIG. 2 wherein an additional cascaded section 42 is added to section 44. The number and value of each of the components of additional cascaded section 42 will be a function of the requirements for broad-banding and isolation as determined by desired and particular usage. An even-odd mode analysis may be utilized to determine these parameters:

The power-divider circuit is composed of a finite number of resistors and equal line lengths. Therefore, the input impedances and various reflection and transmission coefficients can be expressed as quotients of polynomials in S of finite degree, where $$S = -j \cot \theta \tag{3}$$

Synthesis for optimum performance in a given bandwidth is thus reduced to an algebraic problem involving "positive-real" rational input-impedance functions of the complex variable, S. By optimum performance is meant equal-ripple (Chebyshev) behavior of reflection and transmission coefficients in a specified bandwidth, the number of ripples being the maximum possible for the number of circuit sections N.

Figure 4:
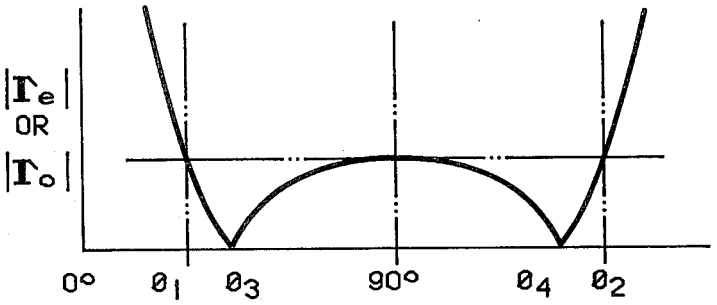
FIG. 4 illustrates a general equal-ripple shape of $|\Gamma e|$ and $|\Gamma o|$ functions in a two section case of FIG. 3.

FIG. 4 shows the general shape of $|\Gamma e|$ vs. $\theta$. This function is symmetrical about $\theta=90°$, and has a ripple maximum at 90° and zero points at $\theta_3$ and $\theta_4=180°-\theta_3$. The equal-ripple band edges are $\theta_1$ and $\theta_3=180°-\theta_1$. The $|\Gamma o|$ function would be similar in shape to $|\Gamma e|$, also having one maximum and two zeros.

The case for N=2 is shown in FIG. 3. This circuit is most easily analyzed by the method of even and odd mode excitations.

The even reflection coefficient is determined to be:

$$\Gamma e = \frac{Z_1Y_2R_2 - 2R_1Z_2Y_1 + (R_2 - 2R_1)S^2 + S[(Z_1 + Z_2 - 2R_1R_2(Y_1 + Y_2)]}{Z_2Y_2R_2 + 2R_1Z_2Y_1 + (R_2 - 2R_1)S^2 + [Z_1 + Z_2 + 2R_1R_2(Y_1 + Y_2)]S}$$

where $S=-j \cot \theta$. To have $\Gamma e=0$ at $\theta_3$ and $\theta_4$, the real and imaginary parts of the numerator must each be zero. Since terms with factors $S^2$, $S^4$, $S^6$, etc. are real and $S^1$, $S^3$, $S^5$, etc. are imaginary, the following relations hold at $\theta_3$:

$$Z_1Y_2R_2 - 2R_1Z_2Y_1 + (R_2 - 2R_1)S^2 = 0 \tag{5}$$

$$Z_1 + Z_2 - 2R_1R_2(Y_1 + Y_2) = 0 \tag{6}$$

Equations (3), (5), and (6) yield $$Z_1^4 - 2R_1Z_1^2(R_2 - 2R_1)\cot^2\theta_3 - (2R_1)^3R_2 = 0 \tag{7}$$

$$Z_2 = \frac{2R_1R_2}{Z_1} \tag{8}$$

A formula relating $\theta_3$ to $\theta_1$ is obtained from e $T_2(x)=2x^2-1$, where $x=(90°-\theta)/(90°-\theta_1)$. The function $T_2(x)$ is the Chebyshev polynomial of second degree. The result is:

$$\theta_3 = 90° - \frac{1}{\sqrt{2}}(90° - \theta_1) \tag{9}$$

$$= 90°\left[1 - \frac{1}{\sqrt{2}}\left(\frac{f_2/f_1 - 1}{f_2/f_1 + 1}\right)\right]$$

Performing the same analysis on the odd mode excitation circuit results in the following design equations for the isolating resistors:

$$R_y = \frac{2Z_1Z_2}{\sqrt{(Z_1 + Z_2)(Z_1 - Z_2\cot^2\theta_3)}} \tag{10}$$

$$R_z = \frac{2R_2R_x(Z_1 + Z_2)}{R_x(Z_1 + Z_2) - 2Z_1R_2} \tag{11}$$

Equations (7), (8), (9), (10), and (11) describe the complete design of a two-section generalized Wilkinson power divided where the terminating impedances are not equal.

It may be seen then that the combining or splitting network has been made to perform required transformations between system impedances in addition to performing the combining or splitting function.

The prior art single section Wilkinson power splitter/combiner provides approximately 14 db of isolation between the second and third ports at the band edges for a one octave bandwidth. This property is retained in the improved splitter/combiner described herein. The isolation is improved in multiple section applications.

While the invention has been particularly shown and described with reference to a preferred embodiment thereof, it will be understood by those skilled in the art that various other modifications and changes may be made to the present invention from the principles of the invention described above without departing from the spirit and scope thereof, as encompassed in the accompanying claims. Therefore, it is intended in the appended claims to cover all such equivalent variations as come within the scope of the invention as described.

What is claimed is:

1. An improvement on a three port Wilkinson power splitter/combiner wherein a first port is matched to a first external impedance, $R_1$, and each of a second and third port are matched to a second external impedance, $R_2$, the first and second impedance being different each from the other, the first port being connected in common to one end of each of a pair of transmission media, another end of each of said transmission media pair being connected each to the other through an impedance, $R_X$, the connection at the end of $R_X$ being the second port and the connection at another end of $R_X$ being the third port, each of the transmission media pair having a length equal to an odd multiple of one-quarter wavelengths at a desired nominal frequency of operation and each of transmission media pair having a characteristic impedance equal to Z where:

$$Z = \sqrt{2R_1R_2}\text{, and}$$

$$R_X = 2R_2.$$

2. An improvement in a three port Wilkinson power splitter/combiner wherein an external impedance, $R_1$, is matched on a first of the three ports, external impedances, $R_2$, are matched on each of second and third ports of the three ports, where $R_1$ is not equal to $R_2$, the power splitter/combiner having a bandwidth defined by $\theta=90°$ at a maximum ripple point, $\theta_3$ and $\theta_4$ are at zero ripple points and $\theta_1$ and $\theta_4$ are at equal-ripple band edges, the improvement comprising:

a first network section comprising a two element first pair of transmission media connected at one end in common to the first port, said first pair of transmission media each having a characteristic impedance, $Z_1$, and being connected at another end, each to the other via an isolating impedance, $R_y$;

a second network section comprising a two element second pair of transmission media, one end of one of said second pair being connected to one end of isolating impedance, $R_y$, one end of the other of said second pair being connected to the other end of said isolating impedance, $R_y$, said second pair of transmission media each having a characteristic impedance, $Z_2$, another end of each of the second pair of transmission media being connected each to the other via an isolating impedance, $R_z$, the connections between $R_z$ and the second pair of transmission media each being connected also to one of the second and third ports, respectively, each element of the first and the second pair of transmission media having a length equal to an odd number of quarter-wavelengths at a nominal frequency of operation and a relationship between values of $R_1$, $R_2$, $R_y$, $R_z$, $Z_1$, $Z_2$, $\theta_1$, $\theta_2$, $\theta_3$ and $\theta_4$ being determined according to the following:

$$Z_1^4 - 2R_1Z_1^2(R_2 - 2R_1)\cot^2\theta_3 - (2R_1)^3R_2 = 0,$$

$$Z_2 = \frac{2R_1R_2}{Z_1},$$

$$\theta_3 = 90° - \frac{1}{\sqrt{2}}(90° - \theta_1),$$

$$R_y = \frac{2Z_1Z_2}{\sqrt{(Z_1 + Z_2)(Z_1 - Z_2\cot^2\theta_3)}}\text{, and}$$

$$R_z = \frac{2R_2R_x(Z_1 + Z_2)}{R_x(Z_1 + Z_2) - 2Z_1R_2}.$$

* * * * *